US005973649A

United States Patent [19]

Andressen

[11] Patent Number: 5,973,649

[45] Date of Patent: Oct. 26, 1999

[54] COMMON APERTURE DUAL MODE SEMI-ACTIVE LASER/MILLIMETER WAVE SENSOR

[75] Inventor: Clarence C. Andressen, Clearwater, Fla.

[73] Assignee: Alliant Techsystems, Inc., Clearwater, Fla.

[21] Appl. No.: 08/959,602

[22] Filed: Oct. 28, 1997

[51] Int. Cl.[6] ..... H01Q 21/00; H01Q 19/00

[52] U.S. Cl. ..... 343/720; 343/725; 343/756; 343/909; 343/708

[58] Field of Search ..... 343/753, 725, 343/872, 756, 721, 720, 705, 909, 911 R

[56] References Cited

U.S. PATENT DOCUMENTS 5,089,828 2/1992 Moss ..... 343/725

5,175,559 12/1992 Schrank et al. ..... 343/756

*Primary Examiner*—Don Wong
*Assistant Examiner*—James Clinger
*Attorney, Agent, or Firm*—Vidas, Arrett & Steinkraus, P.A.

[57] ABSTRACT

A common aperture, dual mode semi-active laser (SAL) and millimeter wave (MMW) sensor having transreflector configured to allow transmission of SAL energy therethrough, a separator and a fresnel lens configured to pass MMW energy therethrough and to focus SAL energy passing therethrough, the separator being configured to separate SAL energy from MMW energy, and a twist reflector positioned in alignment with the transreflector, configured to rotate the polarization of the MMW energy such that, for received MMW energy, the twist reflector reflects and rotates the received MMW energy toward the transreflector, which reflects it onto a feed and comparator, and for transmitted MMW energy, the transreflector reflects toward the twist reflector, whereupon polarization of the transmitted MMW energy is rotated and reflected therefrom to then pass through the transreflector.

11 Claims, 1 Drawing Sheet

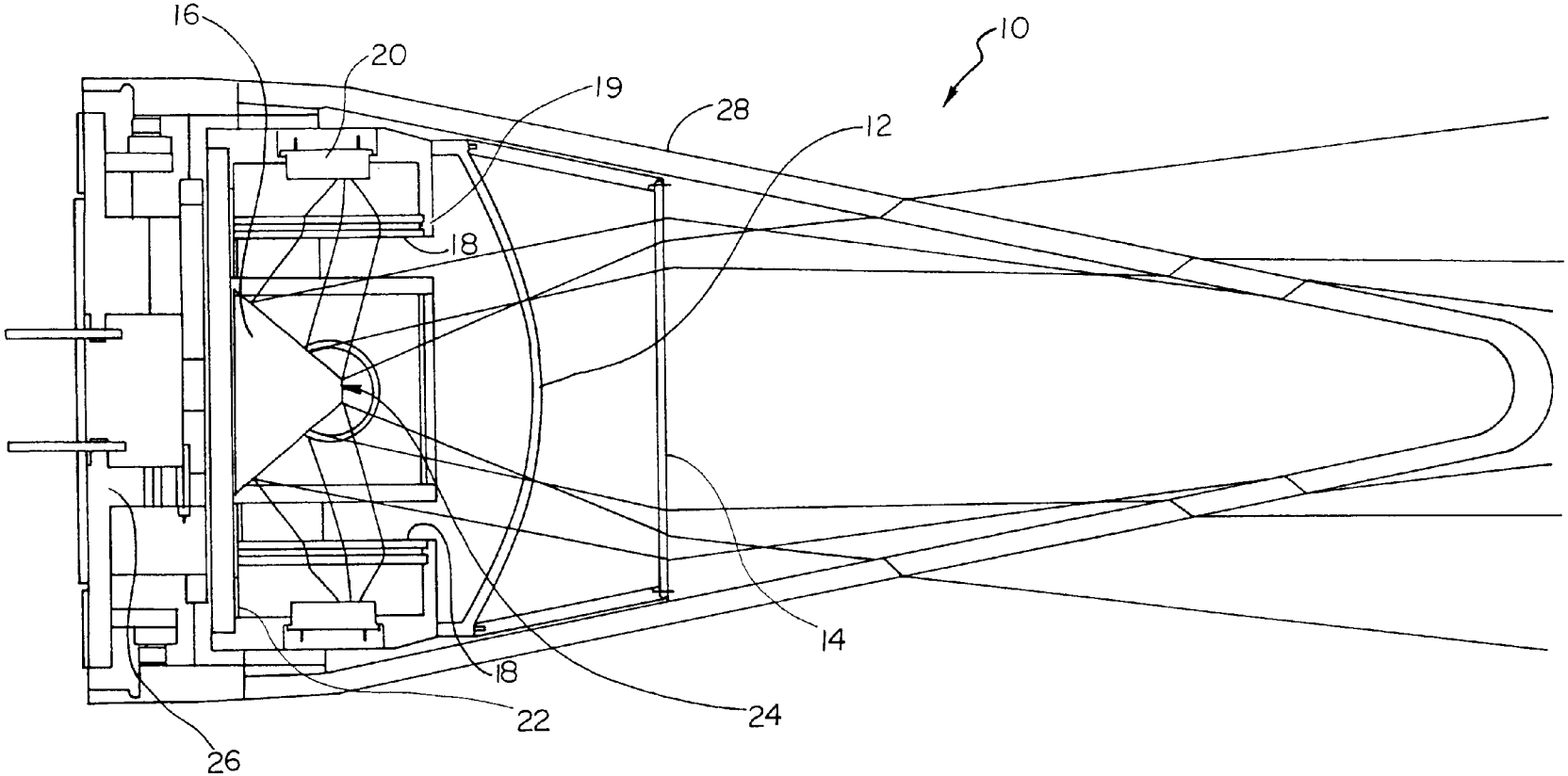
10
12
14
24
28
19
18
18
22
20
16
26

COMMON APERTURE DUAL MODE SEMI-ACTIVE LASER/MILLIMETER WAVE SENSOR

BACKGROUND OF THE INVENTION

1. Field of the Invention

This invention relates to dual-wavelength sensors. More particularly, this invention relates to dual mode millimeter wave and optical sensors employing a common aperture.

2. Description of the Background Art

Dual mode (millimeter wave (MMW) and optical) sensors have traditionally used curved reflectors to collect MMW energy and optical energy and focus such energies on appropriate detectors. In some embodiments, separate apertures for each wavelength band are employed. However, in aperture-limited applications such as missiles or covert sensors, a common aperture is usually employed so as to allow each sensor to collect the maximum incoming energy.

Representative patents include U.S. Pat. No. 4,652,885 entitled "Dual Mode Antenna for Millimeter Wave and Infrared Radiation" and U.S. Pat. No. 4,636,797 entitled "Dual Mode Dichroic Antenna/Aperture". In both of these patents, there is disclosed a dual mode antenna that allows both millimeter wave and infrared radiation to enter a single aperture and propagate through a common transmission device to a point where the respective energies are divided to follow separate paths for subsequent processing. Both patents teach the use of cassegrainian optics for directing the incoming millimeter and infrared energy into the common transmission device in the form of a waveguide. Other representative patents of lesser relevance to the subject invention include U.S. Pat. No. 4,866,454 entitled "Multi-Spectral Imaging System" and U.S. Pat. No. 4,282,527 entitled "Multi-Spectral Detection System with Common Collecting Means". The disclosure of each of the above-referenced patents are hereby incorporated by reference herein.

Presently, there exists a need for increasingly robust gun-launched precision munitions applied to indirect fire against point targets. In order to satisfy such need, autonomous fire-and-forget and man-in-the-loop terminal guidance sensors must be integrated into a single munition. It has been known that an active millimeter wave (MMW) sensor provides the autonomous fire-and-forget terminal guidance capability in adverse weather. Complementarily, a semi-active laser (SAL) that tracks a laser-designated target allows man-in-the-loop terminal guidance capabilities. Combined synergistically, MMW and SAL sensors provide precision guidance to achieve a high hit probability with minimal collateral damage against a broad spectrum of targets and engagements in a variety of battlefield conditions. Unfortunately, successful achievement necessitates integrating the dual sensors (MMW and SAL) with conflicting design constraints into a single compact package with a common aperture.

More specifically, the challenge associated with a common aperture SAL/MMW sensor is the collimation and detection of two widely diverse operating wavelengths on a non-interfering basis. Sensor elements that are used by both SAL and MMW must either be broad-band to encompass both operating wavelengths or have selective coatings to pass one wavelength while reflecting the other. Conversely, sensor elements that are utilized by either SAL or by MMW, but not both, must not significantly interfere with the performance of the other. Accordingly, any acceptable solution must be innovative and employ the appropriate materials to achieve good dual mode performance, relative simplicity and low cost.

Therefore, it is an object of this invention to provide an improvement which overcomes the aforementioned inadequacies of the prior art devices and provides an improvement which is a significant contribution to the advancement of the dual mode common aperture sensor art.

Another object of this invention is to provide a common aperture, dual mode semi-active laser (SAL) and millimeter wave (MMW) sensor apparatus and method, comprising (1) shared elements including a transreflector, a fresnel lens, and a separator, with the transreflector being configured to allow transmission of SAL energy therethrough, with the fresnel lens being configured to pass MMW energy therethrough and to focus SAL energy passing therethrough, and with the separator being configured to separate SAL energy from MMW energy; (2) a field lens positioned in alignment with the SAL energy flowing from the separator for focusing the SAL energy onto a detector; and (3) a twist reflector positioned in alignment with the transreflector, the twist reflector being configured to rotate the polarization of the MMW energy such that, for received MMW energy, the twist reflector reflects and rotates the received MMW energy toward the transreflector whereupon it is reflected therefrom onto a feed and comparator and, for transmitted MMW energy from the feed and comparator, the transmitted MMW is reflected from the transreflector toward the twist reflector whereupon polarization of the transmitted MMW energy is rotated and reflected therefrom to then pass through the transreflector, such that the sensor of the invention is operable in a SAL mode and a MMW mode.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises a common aperture, dual mode semi-active laser (SAL)/millimeter wave (MMW) sensor. Significantly, a principal advantage of the subject invention is the achievement of a robust dual mode SAL/MMW sensor capability within a common aperture with no moving parts. The dual mode SAL/MMW sensor of the invention can be environmentally hardened for high-g environments such as cannon-launched applications. Further, the sensor of the invention can be manufactured at low cost.

More particularly, the SAL/MMW sensor of the invention is based upon the principle of integrating a body-fixed MMW polarization twist cassegrain antenna for MMW operation and four body-fixed laser detectors in a quadrant arrangement for SAL operation. Various collimating and polarizing elements having selective transmission and reflection characteristics, are employed to assure that the performance of the MMW sensor mode and the SAL sensor mode operating with the common aperture, is not degraded significantly than what would normally occur if such sensors were operating separately with their own apertures.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawing in which FIG. 1 is a diagrammatic view of the common aperture dual mode semi-active laser/millimeter wave sensor of the invention incorporated into the nose cone of a cannon-launched projectile.

DETAILED DESCRIPTION OF THE PREFERRED EMBODIMENT

The common aperture dual mode semi-active laser (SAL)/millimeter wave (MMW) sensor 10 of the invention comprises serially positioned fresnel lens 14, transreflector 12 and SAL/MMW separator 16 that function as shared elements of the sensor 10. For SAL mode operation, sensor 10 further comprises four pairs of field lenses 18 and four detectors 20. For MMW mode operation, sensor 10 further comprises a twist reflector 22, a feed and comparator 24 and transceiver 26. Sensor 10 further includes a radome 28.

The radome 28, transreflector 12 and the fresnel lens 14 are composed of a material and are physically configured so as to be transparent to both infrared energy (e.g. 1.06 micron IR) and microwave energy (e.g. 94 GHz). More particularly, radome 28 is preferably manufactured from a low cost plastic such as polycarbonate, (UDEL) polysulfone, or acrylic. The transreflector 12 comprises a uni-directional metallized grid that serves as a polarization reflector for the MMW energy while blocking only a small portion of the SAL energy. The fresnel lens 14 is preferably configured with shallow circular grooves to focus the laser energy onto the SAL/MMW separator 16 without significantly affecting or attenuating the MMW energy.

The SAL/MMW separator 16 preferably comprises a four-sided pyramid with planar surfaces that are selectively coated to respectively reflect SAL energy to the four pairs of SAL collimating lenses 18 and associated detectors 20, while passing the MMW energy through to the twist reflector 22 with minimal disruption. The pyramid separator is made of Vespel™ Poly/mide coated with a multi-layer dielectric mirror coating reflective at 1.06 microns.

SAL Sensor Mode

As noted above, during SAL mode operation, SAL energy passes through the radome 28 to then be focused by the fresnel lens 14, through the transreflector 12 and onto the SAL/MMW separator 16. The four sides of the separator 16 reflect the SAL energy to the four SAL field lenses 18 positioned in a four-quadrant arrangement in respective alignment with the four reflective sides of the separator 16. The SAL field lenses 18 focus the SAL energy onto the respective detectors 20. A typical implementation uses two fresnel lenses paired to form the field lenses. The region between the lenses is used to position the bandpass filter 19 to allow only SAL energy to reach the detectors. Notably, the field lenses 18 are configured to capture all SAL energy reflected from the four reflective surfaces of the separator 16, respectively, for directing such energy to the corresponding detectors 20 of relatively small diameter. The detector signals are combined in a monopulse fashion wherein the outputs of the four detectors 20 are summed to provide source detection and wherein the outputs of the azimuth and elevation detector pairs are each differenced to provide source and angular position, respectively.

MMW Sensor Mode

The MMW sensor mode operates as a receiver as follows. As noted above, the transreflector 12 functions as a polarization reflector for the MMW energy. Thus, MMW energy received with linear polarization orthogonal to the grid passes through the radome 28, the fresnel lens 14, the transreflector 12 and to the twist reflector 22. Twist reflector 22 preferably comprises a quarter-wave structure that rotates the polarization of the incident MMW energy by ninety degrees upon reflection therefrom. Having its polarization now rotated ninety degrees, the reflected MMW energy is now parallel to the metallized grid of the transreflector 12. Consequently, the transreflector 12 reflects the rotated MMW energy and focuses it onto the antenna feed and comparator 24 for monopulse detection.

In the transmit mode, the above-described process occurs in reverse. Specifically, upon transmission of MMW energy from the feed and comparator 24, the transmitted MMW energy is reflected off the transreflector 12 to the twist reflector 22 where its polarization is rotated ninety degrees thereby allowing it to pass through the transreflector 12 without significant degradation.

From the foregoing, it should be appreciated that the invention combines into a common aperture, (1) an active MMW sensor that transmits energy toward targets and receives the reflected energy and (2) a SAL sensor that receives infrared energy reflected from the target such as by a remote target illuminator. The SAL sensor operates in the infrared spectrum preferably at 1.06 micron whereas the MMW sensor preferably operates at 94 GHz. The active MMW sensor provides autonomous terminal guidance in adverse weather conditions whereas the SAL sensor provides man-in-the-loop control during terminal guidance given the remote laser designation of the target. While the performance of the SAL sensor is less robust in adverse weather, the characteristics of the combined MMW and SAL sensors are complementary in the sense that the data derived from each may be combined to achieve performance synergy for various operating scenarios and conditions.

Further, it is noted that the body-fixed SAL sensors provide strapdown terminal guidance with no gimbaled or moving parts. The SAL sensors (and the MMW sensors) are independent monopulse detectors that each provide a sum channel output representing the total collected energy and the difference channel outputs representing the angular position of the source in two orthogonal planes.

The body-fixed SAL sensor implementation achieves a relatively wide field of view (FOV), typically five to eight degrees, suitable for many precision munition applications. The beam width of the MMW sensor implementation is typically narrower for conventional operating frequency and aperture diameter. However, when employed with spinning projectile airframes, the MMW sensor may be positioned offset in angle from the longitudinal axis to thereby broaden the angular coverage. Thus, adequate fields of view are achievable while maintaining the simplicity and low cost of the sensor 10 of the invention with no moving parts.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A common aperture, dual mode semi-active laser (SAL) and millimeter wave (MMW) sensor, comprising in combination:

shared elements including a transreflector, a fresnel lens, and a separator, the transreflector being configured to allow transmission of SAL energy therethrough, said fresnel lens being configured to pass MMW energy therethrough and to focus SAL energy passing therethrough, said separator being configured to separate SAL energy from MMW energy; and a twist reflector positioned in alignment with said transreflector, said twist reflector being configured to rotate the polarization of said MMW energy such that, for received MMW energy, said twist reflector reflects and rotates the received MMW energy toward the transreflector whereupon it is reflected therefrom onto a feed and comparator and, for transmitted MMW energy from said feed and comparator, said transmitted MMW is reflected from said transreflector toward said twist reflector whereupon polarization of the transmitted MMW energy is rotated and reflected therefrom to then pass through the transreflector, whereby the sensor of the invention is operable in a SAL mode and a MMW mode.

2. The sensor as set forth in claim 1, wherein said transreflector comprises an uni-directional metallized grid that functions as a polarization MMW reflector.

3. The sensor as set forth in claim 1 or 2, wherein said separator comprises a multi-sided pyramid configuration whose surfaces are coated to reflect SAL energy incident thereon while allowing passing of the MMW energy therethrough.

4. The sensor as set forth in claim 3 wherein said multi-sided pyramid configuration comprises a four-sided pyramid configuration and wherein four of said field lenses and four of said detectors are positioned in quadrature alignment with said four-sided said pyramid configuration, respectively, such that SAL energy reflected from said four-sided pyramid configuration is captured by respective said collimating lenses for focusing onto respective said detectors.

5. The sensor as set forth in claims 1, wherein said twist reflector comprises a quarter-wave structure that rotates the polarization of incident MMW energy upon reflection therefrom.

6. The sensor as set forth in claims 1, further including a radome.

7. A method of dual mode semi-active laser (SAL) and millimeter wave (MMW) sensor scanning through a common aperture, comprising the steps of:

aligning a transreflector, a fresnel lens, and a separator, said transreflector being configured to allow transmission of SAL energy therethrough, said fresnel lens being configured to pass MMW energy therethrough and to focus SAL energy passing therethrough, said separator being configured to separate SAL energy from MMW energy;

aligning a field lens with the SAL energy flowing from said separator for focusing said SAL energy onto a detector; and aligning a twist reflector with said transreflector, said twist reflector being configured to rotate the polarization of said MMW energy such that, for received MMW energy, said twist reflector reflects and rotates the received MMW energy toward the transreflector whereupon it is reflected therefrom onto a feed and comparator and, for transmitted MMW energy from said feed and comparator, said transmitted MMW is reflected from said transreflector toward said twist reflector whereupon polarization of the transmitted MMW energy is rotated and reflected therefrom to then pass through the transreflector.

8. The method as set forth in claim 7, wherein said transreflector comprises an uni-directional metallized grid that functions as a polarization MMW reflector.

9. The method sensor as set forth in claims 7 or 8, wherein said separator comprises a multi-sided pyramid configuration whose surfaces are coated to reflect SAL energy incident thereon while allowing passing of the MMW energy therethrough.

10. The method as set forth in claim 9 wherein said multi-sided pyramid configuration comprises a four-sided pyramid configuration and wherein four of said collimating lenses and four of said detectors are positioned in quadrature alignment with said four-sided pyramid configuration, respectively, such that SAL energy reflected from said four-sided pyramid configuration is captured by respective said collimating lenses for focusing onto respective said detectors.

11. The sensor as set forth in claims 7, wherein said twist reflector comprises a quarter-wave structure that rotates the polarization of incident MMW energy upon reflection therefrom.

* * * * *